United States Patent [19]

Hattori et al.

[11] 4,419,972

[45] Dec. 13, 1983

[54] AIR-FUEL INTAKE SYSTEM FOR AN INTERNAL COMBUSTION ENGINE

[75] Inventors: Tadashi Hattori; Hitoshi Yoshida, both of Okazaki; Keichi Akutagawa, Nagoya; Akira Takata; Tamotsu Fukuda, both of Toyota, all of Japan

[73] Assignees: Nippon Soken, Inc., Nishio; Toyota Jidosha Kogyo Kabushiki Kaisha, Toyota, both of Japan

[21] Appl. No.: 75,683

[22] Filed: Sep. 13, 1979

[30] Foreign Application Priority Data

| | | | |
|---|---|---|---|
| Sep. 19, 1978 | [JP] | Japan | 53-115527 |
| Dec. 14, 1978 | [JP] | Japan | 53-155474 |
| Dec. 14, 1978 | [JP] | Japan | 53-155475 |
| Dec. 14, 1978 | [JP] | Japan | 53-155476 |
| Dec. 14, 1978 | [JP] | Japan | 53-155477 |
| Dec. 14, 1978 | [JP] | Japan | 53-155478 |
| Dec. 14, 1978 | [JP] | Japan | 53-155480 |

[51] Int. Cl.[3] ..... F02D 9/12

[52] U.S. Cl. ..... 123/337; 123/402; 261/64 R; 261/44 D

[58] Field of Search ..... 123/337, 445, 52 M, 123/52 MC, 52 R, 402, 403; 261/64 R, 64 A, 44 D, 44 H, 61

[56] References Cited

U.S. PATENT DOCUMENTS

| | | | |
|---|---|---|---|
| 1,019,128 | 3/1912 | Bulock | 261/44 D |
| 2,470,014 | 5/1949 | Brown | 261/44 D |
| 3,916,846 | 11/1975 | Kromer | 123/337 |
| 4,096,211 | 6/1978 | Rameau | 261/44 H |

FOREIGN PATENT DOCUMENTS

| | | | |
|---|---|---|---|
| 2743125 | 3/1978 | Fed. Rep. of Germany | 123/337 |
| 318909 | 11/1902 | France | 261/44 D |
| 45664 | 11/1935 | France | 261/44 D |

*Primary Examiner*—Charles J. Myhre
*Assistant Examiner*—Carl Stuart Miller
*Attorney, Agent, or Firm*—Cushman, Darby & Cushman

[57] ABSTRACT

An intake system for an internal combustion engine comprises a throttling system mounted in an intake pipe between a fuel injection valve and an intake manifold, the throttling system including a stationary valve body fixed in the intake pipe in opposition to the injection valve and a hollow valve body mounted in the intake pipe movably in an axial direction of the intake pipe. The hollow valve body has a downwardly converged inner wall surface surrounding the stationary valve body to define therebetween valve opening of variable opening area. The axial movement of the hollow valve body causes the change in the opening area of the valve opening to control an amount of air-fuel mixture charged therethrough into the engine.

11 Claims, 29 Drawing Figures

AIR-FUEL INTAKE SYSTEM FOR AN INTERNAL COMBUSTION ENGINE

BACKGROUND OF THE INVENTION

1. Field of the Invention

The present invention relates to generally an air-fuel intake system for an internal combustion engine and more particularly to an improvement of a throttling system thereof.

2. Description of the Prior Art

The conventional intake systems comprise in general a fuel supply means such as a carburetor and a fuel injection valve, an intake pipe, a butterfly type throttle valve disposed within the intake pipe, and an intake manifold for distributing the air-fuel mixture to the engine cylinders.

The intake systems of the type described above has a problem that the uniformity of air-fuel mixture distribution cannot be completely ensured so that the high and reliable engine performance cannot be ensured and the emission of pollutants is high. The main cause of this problem is that the fuel supplied from the fuel supply means adheres to the wall surfaces of the intake pipe and forms the films. These fuel films flow along the intake manifold wall into the engine cylinders in varying quantities so that the air-fuel ratios of the combustion mixtures charged into the engine cylinders vary from one cylinder to another. The adhesion of the fuel to the wall surfaces and the resultant formations of the fuel films are in turn attributed to the fact that the fuel has not been satisfactorily atomized and uniformly mixed with the combustion air.

Another cause is attributed to the butterfly type throttle valve which is not positioned symmetrically with respect to the axis of the air-fuel passage so that non-uniform distributions or the localized concentrations of the air-fuel mixtures result. In addition, the butterfly valve is so designed and arranged as to rotate, thereby varying the opening area so that the geometrical relationship between the butterfly type throttle valve and the fuel supply means changes from time to time depending upon the operating conditions of the engine and consequently the localized concentrations of fuel are further enhanced.

In the intake systems wherein the fuel injection valve is positioned at the upstream of the throttle valve, the fuel injection pressure is considerably higher than the pressures around the throttle valve and the fuel is injected independently of the flowing conditions of the air. As a result, the air-fuel ratio becomes high when the air flow rate is high, and vice versa. Thus the fuel-air ratios of the combustion mixtures charged into the engine cylinders vary from one cylinder to another and from time to time.

SUMMARY OF THE INVENTION

In view of the above, one of the objects of the present invention is to provide an intake system for an internal combustion engine which may ensure the almost complete atomization of the fuel and the elimination of localized concentrations of the fuel so that the uniformity of the air-fuel mixture distribution may be ensured and consequently the higher and more reliable engine performance may be ensured and the emission of pollutants may be substantially suppressed.

Another object of the present invention is to provide an intake system for an internal combustion engine that may ensure the smooth and optimum control of the flow rate of the air-fuel mixture over the whole range of the engine operations.

To the above and other ends, briefly stated, the present invention provides an intake system for an internal combustion engine wherein a stationary valve body is securely held in spaced and opposed relationship with a fuel supply means such as a fuel injection valve and a carburetor, and a movable hollow valve body (which interchangeably is referred to as "the movable tubular body") is so arranged as to move with respect to the stationary valve body in the axial direction thereof in such a way that a part of the outside wall surfaces of the movable hollow valve body slides over the inside wall surface of the intake pipe in an air-tight intimate contact therewith and the inside wall surface of the movable hollow valve body cooperates with the stationary valve body to vary the opening area of the intake pipe.

The above and other objects, features and advantages of the present invention will become more apparent from the following descriptions of the preferred embodiments thereof taken in conjunction with the accompanying drawings.

BRIEF DESCRIPTION OF THE DRAWINGS

Same reference numerals are used to designate similar parts throughout the figures.

DESCRIPTION OF THE PREFERRED EMBODIMENTS

Figure 1:
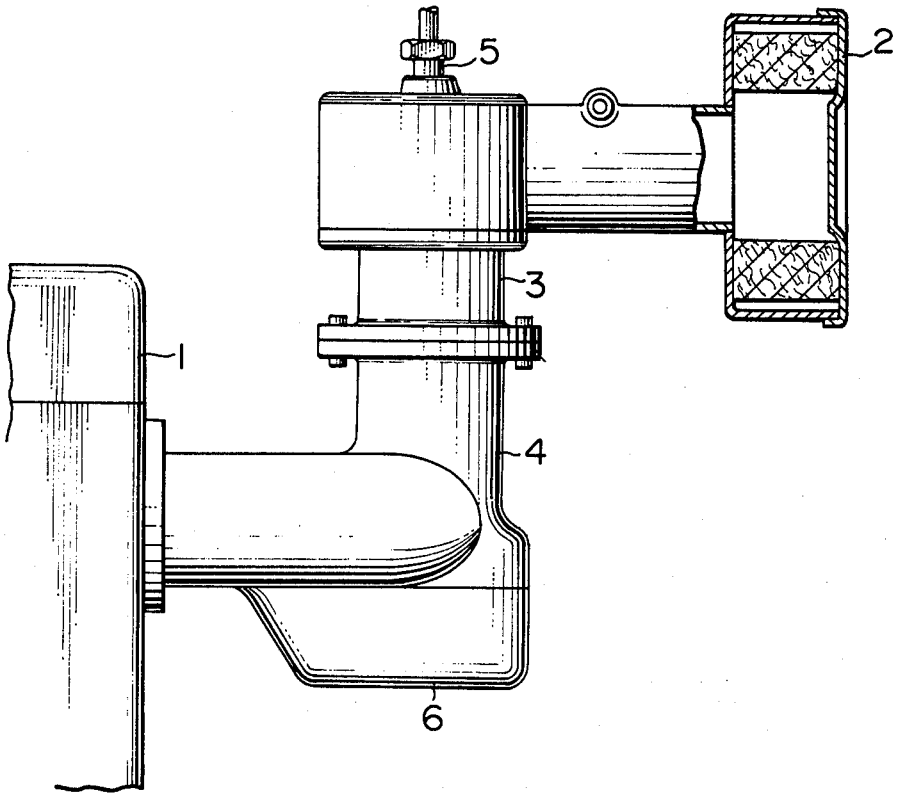
FIG. 1 is a side view of a first embodiment of an intake system in accordance with the present invention.
Figure 2:
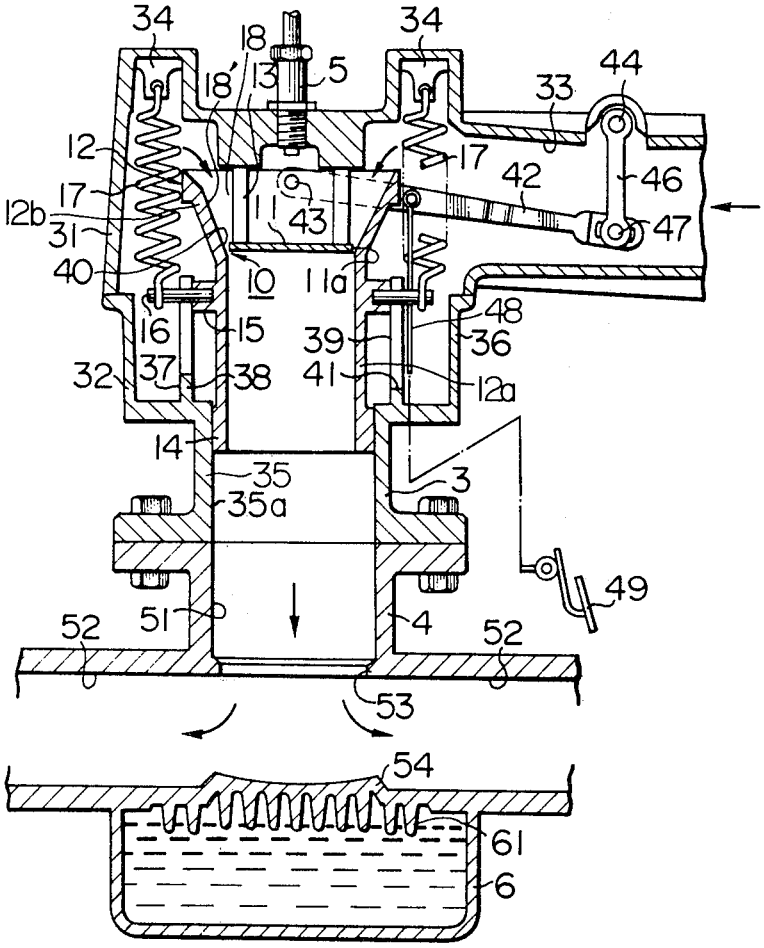
FIG. 2 is a longitudinal sectional view thereof.

First Embodiment, FIGS. 1 and 2

FIG. 1 shows a first embodiment of the present invention. The combustion air is charged through an air cleaner 2, an intake pipe 3 and an intake manifold 4 into a four-cycle, ignition type, multicylinder automotive engine 1 of the conventional type. The fuel such as gasoline is charged into the intake pipe 3 and is mixed with the air before charged into the engine 1.

A heater 6 is mounted on the intake manifold 4 and the cooling water discharged from the engine 1 is circulating through the heater 6 as will be described in detail below, thereby heating the intake manifold 4.

The fuel such as gasoline is charged by a fuel supply means 5. The fuel is supplied under pressure from a fuel pump (not shown) and the quantity of the fuel to be injected is controlled or metered by the fuel supply means depending upon the operating conditions of the engine 1.

Next referring to FIG. 2, the intake pipe 3 and a throttling system 10 incorporated therein will be described in detail below. The intake pipe 3 comprises an upper half 31 and a lower half 32. The upper half 31 has an air horn 33 which extends toward (right in FIG. 2) and is connected to the air cleaner 2 and whose cross sectional area is gradually reduced toward the air cleaner 2. The fuel supply means or fuel injection valve 5 is screwed into the top wall of the upper half 31. Four spring retainers or hangers 34 are depending from the top wall and are equiangularly spaced apart from each other.

The lower half 32 has a lower small-diameter portion 35 which defines the air-fuel mixture passage and an upper large-diameter portion 36 which is contiguous with the lower small-diameter portion 35 and is connected to the upper half 31.

Next the throttling system 10 will be described which includes a stationary valve body 11 and a movable tubular body 12. The stationary valve body 11 is in the form of a disk and is suspended by means of four equiangularly spaced suspension rods 13 (only two is shown in FIG. 2) from the top wall of the upper half 31 in the air passage defined in the latter in spaced apart and opposed relationship with the fuel injection valve 5.

The movable tubular body 12 comprises a lower hollow cylindrical portion 12*a* and an upper flared or upwardly diverged portion 12*b* which defines, for instance, a frustoconical metering passage 18 which is coaxial with the stationary valve body 11. The lower cylindrical portion 12*a* of the tubular body 12 has a first or lower flange 14 formed at the lower open end and a second or upper flange 15 which is formed adjacent to the boundary between the lower cylindrical portion 12*a* and the flared portion 12*b* and spaced apart from the first or lower flange 14 by a suitable distance. The first or lower flange 14 is in an air-tight contact with the inside wall surface 35*a* of the lower cylindrical portion 35 of the lower half 32 while the second or upper flange 15 is also in an air-tight contact with the inside surface of a cylindrical guide wall 37 extending vertically upwardly from the bottom of the upper large-diameter portion 36 coaxially thereof by a suitable height. Thus the movable tubular body 12 may slide in the vertically axial direction of the intake tube 3 with the first or lower and second or upper flanges 14 and 15 in air-tight contact with the inside wall surfaces thereof.

Four (only two is shown in FIG. 2) pins 16 radially outwardly extends from the second or upper flange 15 of the tubular body 12 and are equiangularly spaced apart from each other and extension coiled springs 17 are loaded between these pins 16 and the spring retainers or hangers 34 so that the tubular body 12 may be normally biased upwardly or toward the fuel injection valve 5. The guide pins 16 are slidably fitted into four equiangularly spaced vertical, elongated guide slots 39 formed through the cylindrical guide wall 37 so that not only the vertical stroke of the tubular body 12 may be limited but also the rotation of the tubular body 12 about its axis may be prevented.

It can be readily seen that an opening 40 is defined between the frustoconical metering surface 18′ of the tubular body 12 and the stationary valve disk 11 and is variable in opening area as the tubular body 12 is moved downward or upward. That is, as the tubular body 12 is forced to move down, the opening 40 is increased, and vice versa. Thus, the opening 40 constitutes a valve opening. The metering surface 18′ has been described as being frustoconical, but it is to be understood that the metering surface 18′ may have any suitable curvature or cross section so that the opening 40 varies its opening area as any desired function of the displacement or stroke of the tubular body 12. For instance, the opening area may be linearly, stepwise or exponentially varied as the tubular body 12 moves up and down. At the upper end of the stroke of the tubular body 12 which is limited by the upper ends of the guide slots 39, the metering surface 18′ of the tubular body 12 is brought into very close contact with the peripheral edge 11*a* of the stationary valve disk 11, whereby the intake pipe 3 may be completely closed. On the other hand, at the lower end of the stroke which is limited by the lower ends 41 of the guide sots 39, the opening 40 becomes widest. That is, the upper and lower ends of the stroke of the tubular body 12 correspond to the closed throttle and full throttle positions, respectively.

One end of a lever 42 is pivoted with a pivot pin 43 to the tubular body 12 adjacent the upper end thereof, while the other end is pivoted with a pivot pin 47 to one end of a crank 46 whose the other end is pivoted with a pivot pin 44 to the air horn 33. The pivot pin 47 is fitted through an axially elongated slot formed at the other end of the lever 42 so that the distance between the pivot pins 43 and 47 may be changed as needed. One end of a wire 48 is jointed to the lever 42 at a point between its pivot pins 43 and 47, while the other end of the wire is operatively connected to a throttle control means such as an accelerator pedal 49.

When a driver depresses the accelerator pedal 49, the wire 48 pulls down the lever 42 so that the tubular body 12 is caused to move downwards against the bias springs 17, but when the driver releases the accelerator pedal 49, thus releasing the wire 48, the tubular body 12 returns upwards under the forces of the bias springs 17.

At the lower end of the inlet passage 51 of the intake manifold 4 where the inlet passage 51 meets a distribution passage 52 of the intake manifold 4, an annular projection or flange 53 is radially inwardly extending by a suitabl distance and the upper edge of the flange 53 is beveled at an angle greter than 15°. This annular flange 53 may be cut off at several points.

In the heater 6 a plurality of heat-exchanging fins 61 are extended from the rear surface of a "hot spot" projection 54 raised slightly in the distribution passage 52 of the intake manifold 4 in opposed relationship with the inlet passage 51 so that the heat of the cooling water which is circulating through the heater 6 may be efficiency carried away to the "hot spot" projection 54. Instead of the cooling water, the exhaust gases may flow through the heater 6 or the "hot-spot" projection 54 may be directly heated by an electric heater.

Next the mode of operation of the first embodiment with the above construction will be described. When the driver depresses the accelerator pedal 49 to pull the wire 48, the tubular throttle body 12 is caused to move down gainst the forces of the bias springs 17 as described hereinabove so that the opening 40 between the tubular throttle body 12 and the stationary valve disk 11 widens accordingly. The combustion air flows through the air cleaner 2, the intake pipe 3 and the intake manifold 4 into the engine 1. The fuel injection valve 5 injects the fuel in such a quantify that when the injected fuel is mixed with the air which is flowing through the intake pipe 3 at a flow rate dependent on the stroke or position of the tubular body 12, the air-fuel mixture may be prepared whose air-fuel ratio is optimum to the operating conditions of the engine 1. The injected fuel impines against the stationary valve disk 11 which is spaced apart from the tip of the fuel injection valve 5 by a predetermined distance and forms a thin film over the stationary valve disk 11. The formed thin film expands radially outwardly, and when it leaves from the peripheral edge 11*a* of the disk 11, it is atomized by the air flowing at high velocities through the opening 40 and then vaporized, whereby the combustion mixture with an optimum air-fuel ratio may be obtained. The fuel and air are further uniformly mixed as the mixture flows along the frustoconical metering surface 18' toward the axis of the tubular body 12 and axially into the intake manifold 4 through the combustion mixture passage in the intake pipe 3 and the inlet passage 51. From the intake manifold 4 the combustion mixture is charged into the cylinders of the engine 1 as is well known in the art. The combustion mixture with an optimum, uniform air-fuel ratio may ensure the higher performance of the engine and the minimum emission of pollutants such as HC (hydrocarbons).

The geometrical relationship between the fuel injection valve 5 and the stationary valve disk 11 remains unchanged independent of the operating conditions of the engine 1 so that the fuel injected may be uniformly distributed over the valve disk 11 and consequently non-uniform distribution of the air-fuel mixture can be completely avoided in the intake pipe 3. The injected fuel is atomized along the whole peripheral edge 11*a* of the stationary valve disk 11 and the atomized fuel particles flow along the frustoconical metering surface 18' toward the axis of the tubular body 12 so that non-uniform distribution of the fuel particles into the combustion air may be avoided. In addition, the fuel which adheres to the inside wall surfaces 35*a* of the lower small-diameter cylindrical portion 35 of the lower half 32 of the intake pipe 3 may be reduced in quantity drastically and consequently the formation of a fuel film thereover may be minimized. A very small quantity of fuel flows down the inside wall surface in the form of a film into the intake manifold, but the fuel film is separated by the projection or projections 53 at the lower end of the inlet passage 51 from the inside wall surface thereof and falls upon the "hot spot" projection 54 so that the fuel is vaporized again and entrained in the air-fuel mixture into the cylinders of the engine 1. Thus the air-fuel mixture can be charged into the cylinders in an optimum and more uniform air-fuel ratio.

Second Embodiment, FIG. 3 through FIG. 6

In the first embodiment, the tubular body 12 is permitted to slide air-tightly in the intake pipe 3 with the first or lower and second or upper flanges 14 and 15 kept in very intimate contact with the wall surfaces of the intake pipe 3. In the second embodiment shown in FIG. 3, in addition to the first or lower and second or upper flanges 14 and 15, the tubular body 12 is further formed with a third flange 101 along the upper edge of the flarged portion thereof, and the third flange 101 is made into an air-tight intimate contact with inside wall surface of a cylindrical guide wall 102 formed integral with and extending downwardly from the upper half 31A of the intake pipe 3 coaxially thereof.

Figure 4:
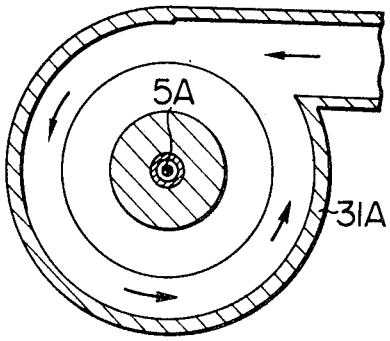
FIG. 4 is a sectional view taken along the line IV—IV of FIG. 3.

Furthermore according to the second embodiment as shown in FIG. 4, the combustion air from the air cleaner 2 flows tangentially into the upper half 31A which is circular in cross section as indicated by arrows.

In addition, a swirling type electromagnetic fuel injection valve 5A is used.

Instead of coupling the wire 48 to the tubular body 12 through the lever 42, the wire 48 is coupled to the body 12 through a cam 103. The cam 103 is rotatably connected to the body 12 through a pin 106, fixed to the latter, and is connected also to a stationary part such as the air horn or upper half 31A through another pin 108 which extends through a slot formed in the cam 103. When the driver depresses the accelerator pedal 49 to pull the wire 48, the cam 103 is caused to swing, thereby causing the tubular body 12 to move downwards. When the wire 48 is released, the tubular body 12 is moved upwards under the forces of the bias springs 17 as in the first embodiment. In the second embodiment the spring retainers or hangers 34 which retain the upper ends of the bias springs 17 projects from the annular shoulder or step between the upper half 31A and its guide wall 102.

Figure 5:
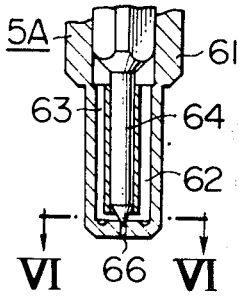
FIG. 5 is fragmentary longitudinal sectional view of a fuel injection valve used in the second embodiment shown in FIG. 3.
Figure 6:
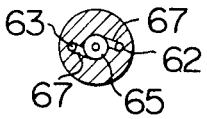
FIG. 6 is a sectional view taken along the line VI—VI of FIG. 5.

In FIGS. 5 and 6 is shown in detail the electromagnetic fuel injection valve 5A which has a main body 61 having two axially parallel fuel passages 62 and 63 and a needle valve element 64 fitted into the body 61 for axial slidable movement. The fuel injection valve 5A further includes a swirling chamber 65 in which the fuel is swirled, a nozzle 66 communicated with the swirling chamber 65 for injecting the fuel, and tangential inlet passages 67 which serve to cause the fuel to flow from the axial fuel passages 62 and 63 into the swirling chamber 65 in the tangential directions. The operation of the fuel injection valve 5A is controlled by the control signal output from an electronic control unit 105 which in turn is responsive to the output signal from an air flow meter 104 disposed in the passage between the air cleaner 2 and the intake pipe 3 in order to measure the flow rate of the air flowing through this passage. Since the control system for controlling the fuel injection valve 5A in the manner described above is well known in the art and does not constitute the present invention, no further description will be made in this specification.

When the winding (not shown) of the fuel injection valve 5A is energized in response to the signal from the electronic control unit 105, the needle valve element 64 is caused to be lifted upward to open the nozzle hole of the nozzle 66 so that the fuel is injected toward the stationary valve disk 11. Since the fuel is forced to swirl in the swirling chamber 65, the angle of spray becomes so wide that the injected fuel may be impinged against the whole surface of the stationary valve disk 11 far more uniformly as compared with the arrangement wherein a fuel injection valve of ordinary type is used. As a result, non-uniform distributions or localized concentrations of the fuel particles may be prevented very effectively.

The mode of operation of the second embodiment is substantially similar to that of the first embodiment described in detail with reference to FIG. 2 so that no further description will be made in this specification.

Figure 7:
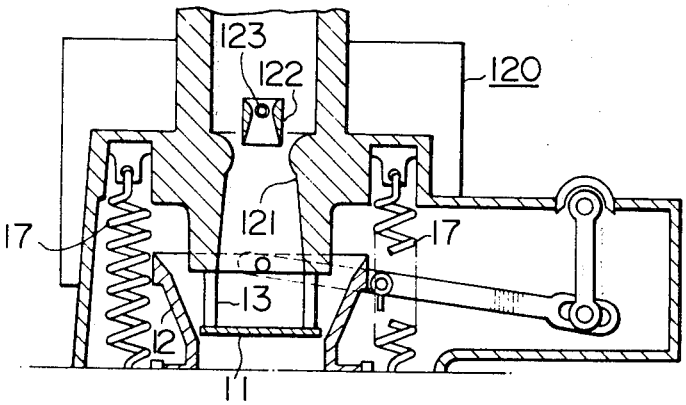
FIG. 7 is a longitudinal sectional view of a modification of a fuel supply means used in the second embodiment shown in FIG. 3.

In the first and second embodiments, the fuel supply means has been described as comprising the fuel injection valve, but instead of the fuel injection valve a conventional carburetor 120 featured in a double venturi consisting of a primary venturi 122 with a discharge nozzle 123 and a secondary venturi 121 may be used as shown in FIG. 7.

In both the first and second embodiments, the movable tubular body 12 has been described as, as its name implies, being circular in cross section, but its cross section and the configuration of the stationary valve body 11 may be varied as needed.

Figure 8:
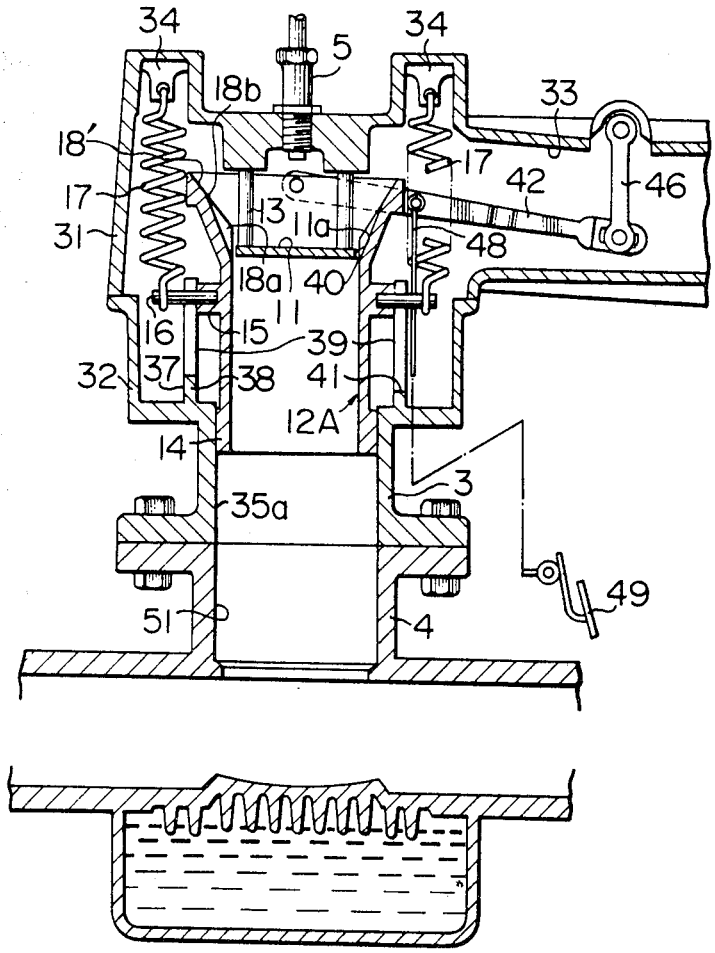
FIG. 8 is a longitudinal sectional view of a third embodiment of the present invention.
Figure 9:
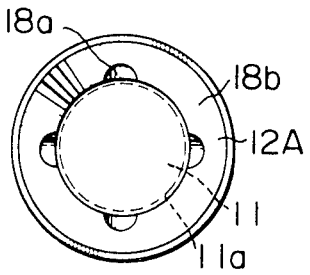
FIG. 9 shows the relative arrangement between a stationary valve body and a movable hollow valve body used in the third embodiment shown in FIG. 8.

Third Embodiment FIGS. 8 and 9

The third embodiment shown in FIG. 8 is substantially similar in construction to the first embodiment shown in FIG. 2 except that the inside metering surface 18' of the movable tubular body 12A has a first metering surface **18*b* which is shown as a frustoconical surface converged downwards as in the first embodiment, and second metering passages 18*a* each of which is defined by a part of conical surface with the vertex positioned downwards as shown in FIG. 9. The second metering passages 18*a* are defined by notches or recesses formed in the surface 18*b*. In FIG. 9 four second metering passages 18*a* are shown which are equiangularly spaced apart from each other. The boundary between the first metering passage 18*b* and the second metering passages 18*a* corresponds to the flex or transition point of a characteristic curve B (dotted lines) in FIG. 10. Both the first and second metering passages have been described as having frustoconical surface and a partially conical surface, respectively, but as in the first embodiment they may have any suitable curved surfaces so that the opening area S between the stationary valve disk 11 and the movable tubular body 12A may be varied in any suitable manner as a function of the stroke L of the tubular body 12A. It is preferable that the semivertical angle, i.e., the angle of inclination in an axial direction of both the first and second metering passages 18*b* and 18*a*** be greater than 10° in order to facilitate the atomization of the fuel.

Until the tubular metering body 12A reaches the flex or transition point in the low flow-rate operating conditions, the air and fuel flow through the second metering passages **18*a*, mixing with each other. In the case where the second metering passages 18*a* consisting of notches or recesses are eliminated, the area of the opening 40 changes rapidly and widely as the tubular metering body 12 moves up and down. This stroke-opening area characteristic is shown by a curve A in FIG. 10. It is to be noted that the curve A was obtained with the replacement of the above-mentioned second passages 18*a* by a tapered or downwardly converged second metering passage which has smaller semivertical angle than that of the first metering passage 18*b*. As will be understood from the curve A, in order to decrease the gradient of the characteristic curve, the semivertical angle must be reduced. However, with the reduced semivertical angle, not only the fuel adhering to the metering surface 18'** is increased in quantity but also it is difficult to fabricate such a metering surface having an acute semivertical angle with a desired degree of accuracy.

Figure 10:
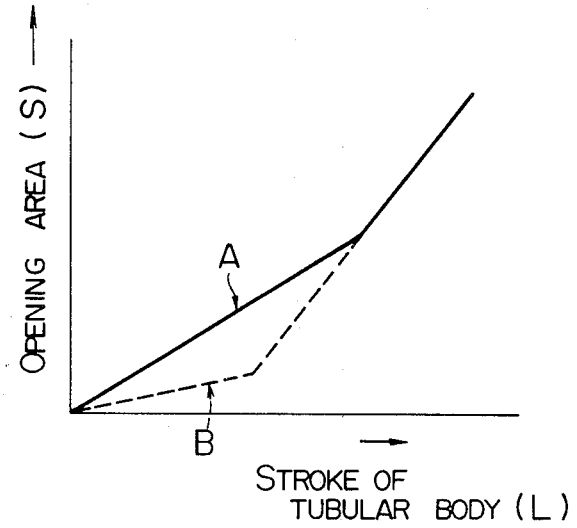
FIG. 10 is a graph used for the explanation of mode of operation and meritorious effects of the third embodiment.
Figure 11:
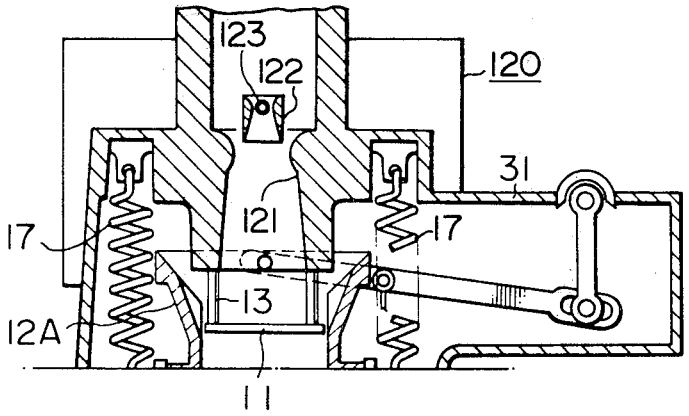
FIG. 11 is a longitudinal sectional view of a modification of a fuel supply means used in the third embodiment shown in FIG. 8.

In view of the above, according to the third embodiment, the metering passage includes the first metering passage **18*b* and the second metering passages 18*a* so that the slope of the stroke-opening area characteristic curve in the low flow-rate operating condition may be decreased as indicated by the curve (dotted line) B in FIG. 10 until the movable tubular metering body 12A reaches the transition point. After the tubular metering body 12A passes the transition point, the slope of the characteristic curve may be increased as shown in FIG. 10. Thus without unnecessarily reducing the semivertical angle of the first metering passage 18*b***, desired stroke-opening area characteristic curves may be attained which may ensure an optimum air-fuel ratio and may minimize the adhesion of the fuel to the metering surfaces.

As in the case of the second embodiment, instead of the fuel injection valve 5, a conventional carburetor 120 having, for instance, a double venturi consisting of a primary venturi 122 with a discharge nozzle 123 and a secondary venturi 121 may be used. Furthermore instead of the metering body 12A having a circular cross sectional configuration, a metering body having any suitable cross section may be used as needed. In this case, the configuration of the stationary valve body 11 must be changed correspondingly.

The configuration and dimensions of the second metering passages **18*a* may be varied as needed and it is preferable to provide more than four passages 18*a*. Furthermore, the semivertical angle or the angle of inclination which may be defiend as the angle between the axis of the movable metering body 12A and the curved surface defining each second metering passage 18***a* is preferably between 10° and 45°.

In summary, according to the third embodiment, in the case of starting, idle or low speed; that is, when the flow rate of the combustion mixture to be charged into the cylinders of the engine 1 is relatively low, the air and fuel are metered by the opening area defined between the stationary valve body and the second metering passages 18*a*. Any desired stroke-opening area characteristic curves may be selected with a higher degree of accuracy by selecting the suitable dimensions, configurations, positions and number of the secondary metering passages without adversely affecting the atomization capacity of the throttling system. Thus the uniform combustion mixture with an optimum air-fuel ratio may be charged into the cylinders of the engine 1 even at starting, idle and low speeds.

Fourth Embodiment, FIG. 12 through FIG. 15

Figure 12:
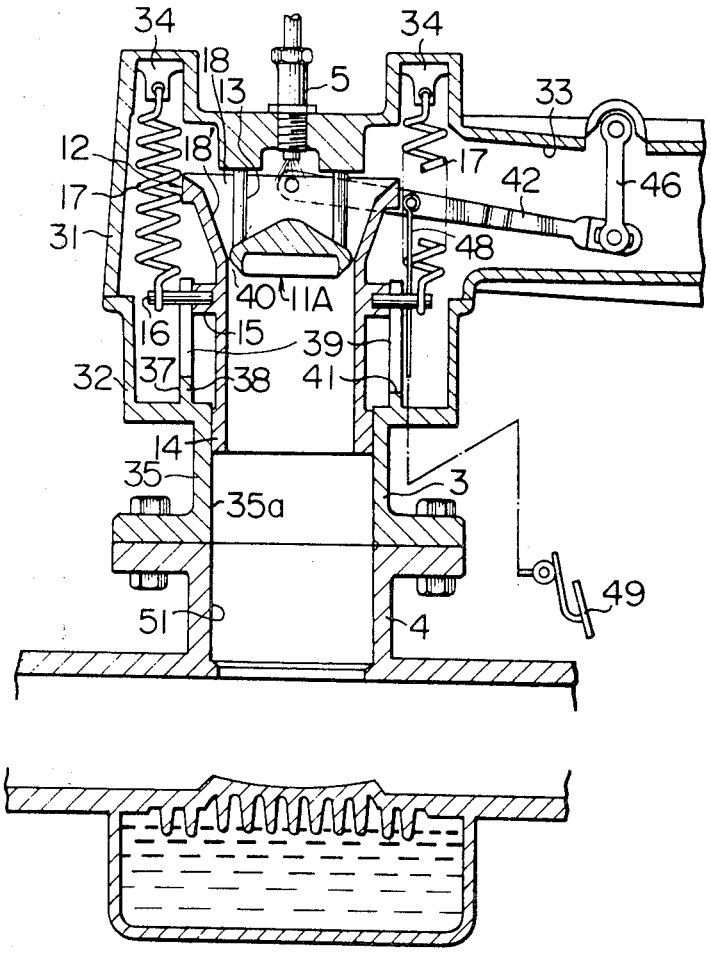
FIG. 12 is a longitudinal sectional view of a fourth embodiment of the present invention.
Figure 13:
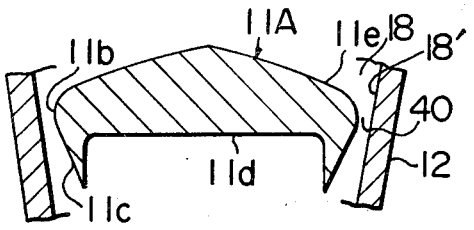
FIG. 13 is a schematic view, on enlarged scale, illustrating the relationship between a stationary valve body and a movable hollow valve body used in the fourth embodiment shown in FIG. 12.

The fourth embodiment shown in FIGS. 12 and 13 is substantially similar in construction to the first embodiment shown in FIG. 2 except that while in the first embodiment the stationary valve body 11 is a flat disk, a stationary valve body 11A has a convex top surface or is nearly in the form of a cone as best shown in FIG. 13. That is, the stationary valve body 11A has, for instance, a smooth conical top surface 11*e* connected to a spherical, peripheral zone 11*b* which in turn is connected to the large base of a frustum of a zone 11*c*. The zone 11*b* has the largest diameter so that its surface and the wall surface 18' of the metering passage 18 of the tubular body 12 defines the narrowest gap or opening 40. The surface of the stationary valve body 11A may be generated by any suitable generating curve consisting of one or more line segments and/or one or more arcs. The bottom of the stationary valve body 11A is recessed as indicated by 11*d*.

The fuel injected from the fuel injection valve 5 is substantially impinged against the conical surface 11*e* of the valve body 11A which is spaced apart from the injection valve 5 by a predetermined distance. The fuel sprayed over the conical surface 11*e* forms a thin film which radially outwardly expands from the vertex of the cone 11*e*. When the fuel film is separated from the curved outermost peripheral surface 11*b*, it is atomized by the air passing through the opening 40, whereby the combustion mixture in which the air and fuel are uniformly mixed may be obtained.

Since the conical surface 11*e* is gradually inclined radially outwardly from its vertex, the fuel sprayed over the conical surface 11*e* may immediately flow toward the curved surface 11*b*. Since the opening 40 is defined by the smooth curved surface 11*b* and the smooth surface of the metering passage 18, there occurs no contraction of the air flow in the opening 40 so that the air-fuel mixture may pass through the opening 40 with a minimum pressure loss.

The fuel which flows along the curved, outermost peripheral surface 11*b* towards the guide surface 11*c* is separated therefrom along the lower edge and flows through the passage in the intake pipe 3. Since the guide surface 11*c* is converging downwardly, the pressure loss may be minimized.

After passing through the opening 40, the air-fuel mixture flows along the downwardly converged surface of the metering passage 18 toward the axis thereof, whereby the air and fuel may be more uniformly mixed. Thus prepared air-fuel mixture is charged into the cylinder of the engine 1 through the intake manifold.

As described elsewhere, the geometrical relative arrangement between the stationary valve body 11A and the fuel injection valve 5 remains unchanged irrespective of the operating conditions of the engine so that the fuel injection through the injection nozzle 5 may be uniformly distributed over the conical surface 11*e* and the localized concentrations of the air-fuel mixture may be avoided in the passage of the intake pipe 3. When the fuel film reaches the outermost peripheral surface 11*b*, it is atomized and the atomized particles are forced to flow along the inclined surface 18' of the metering passage 18 so that the local concentrations of the air-fuel mixture are prevented more effectively. Further, the fuel adhering to the inside surfaces 35*a* of the small-diameter portion or section 35 of the lower half 32 may be minimized in quantity and consequently the formation of the fuel film over this surface 35*a* may be prevented.

In summary, according to the fourth embodiment no contraction of the air flow occurs in the opening 40 defined between the stationary valve body 11A and the movable hollow valve body 12 so that the pressure loss may be minimized. In addition the adhesion of the fuel to the bottom of the movable hollow valve body 12 may be prevented. Thus, the uniform atomization of the fuel may be much facilitated.

Figure 14:
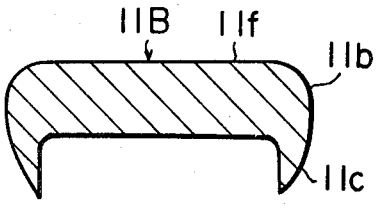
FIG. 14 is a sectional view of a modification of the stationary valve body of the fourth embodiment.

So far the stationary valve body 11A has been described as having the raised surface 11*e* such as a conical, spherical, elliptical or parabolic surface, but when the fuel injection pressure is high, a stationary valve body 11B having a flat fuel receiving surface 11*f* as shown in FIG. 14 may be used which also has the outermost curved peripheral surface 11*b* contiguous with the downstream guide surface 11*c* as with the stationary valve body 11A shown in FIG. 13.

Figure 15:
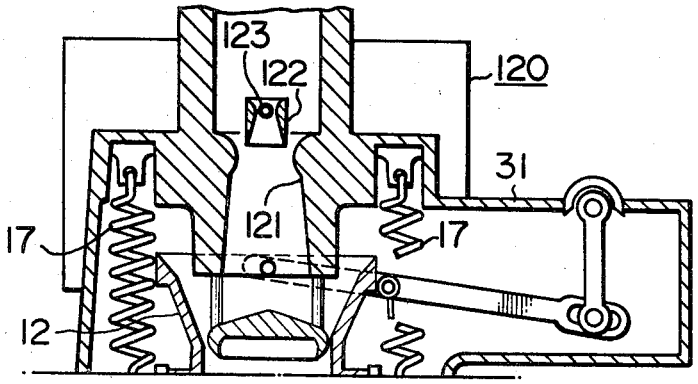
FIG. 15 is a longitudinal sectional view of a modification of a fuel supply means used in the fourth embodiment.

As with the second and third embodiments, instead of the fuel injection valve 5, a conventional carburetor 120 featured in a double venturi consisting of a primary venturi 122 with a discharge nozzle 123 and a secondary venturi 121 as shown in FIG. 15 may be used.

Furthermore, as described elsewhere the movable tubular body or valve body 12 may have any desired cross sectional configuration in addition to a circular cross sectional configuration shown in FIG. 12. The stationary valve body 11A or 11B must have a shape corresponding to the selected cross sectional configuration of the movable hollow valve body 12.

Figure 16:
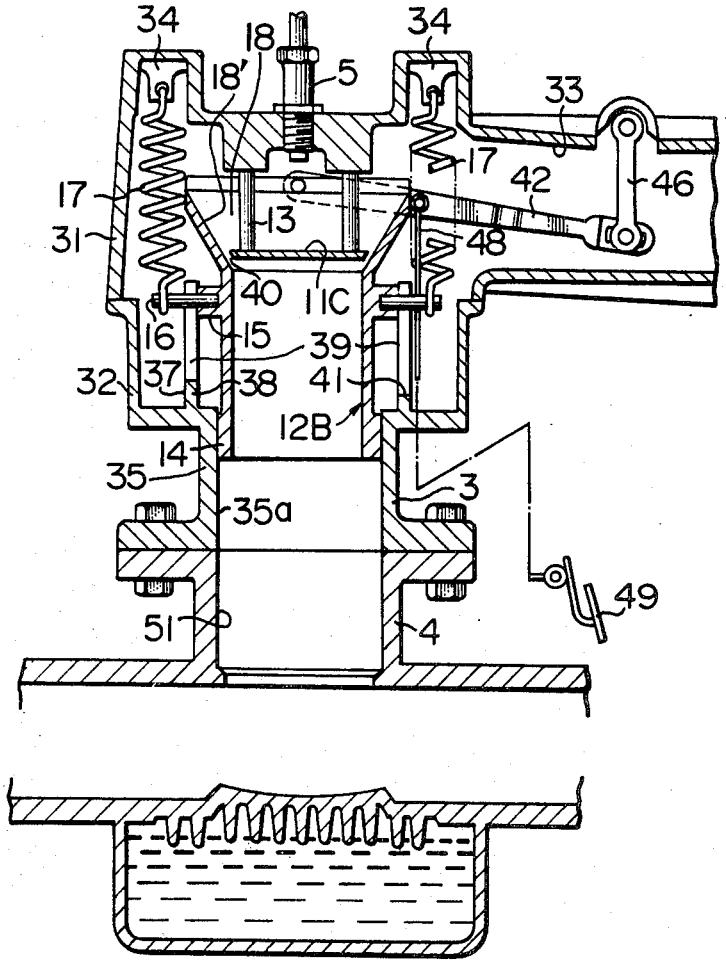
FIG. 16 is a longitudinal sectional view of a fifth embodiment of the present invention.
Figure 17:
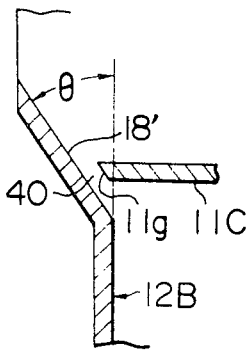
FIG. 17 is a fragmentary view, on enlarged scale, illustrating the relationship between a stationary valve body and a movable hollow valve body used in the fifth embodiment.

Fifth Embodiment, FIGS. 16 and 17

The fifth embodiment shown in FIGS. 16 and 17 is also substantially similar in construction to the first embodiment shown in FIG. 2 except that the angle $\theta$ of inclination (or the semivertical angle when the surface 18B is conical) of the surface 18' of the metering passage 18 of the movable hollow valve body 12B is defined between 35° and 55° and that the circumferential edge of the stationary valve body or disk 11C is beveled as indicated by 11*g*. The opening 40 is therefore defined between the metering surface 18' and the beveled edge 11*g* of the stationary valve body or disk 11C. The extension of the beveled edge 11*g* converges downwardly toward the axis of the movable hollow valve body 12B.

As described elsewhere, the metering passage 18 of the movable hollow valve body 12B may have any suitable curved or stepped surface so that any desired stroke-opening area characteristic curves may be obtained (See FIG. 10).

As described elsewhere, the movable hollow valve body 12B moves between the closed throttle position at which the opening 40 is completely closed (it is preferable that the beveled edge 11*g* of the stationary valve body or disk 11C is in parallel with the metering surface 18' of the movable hollow valve body 12B so as to ensure the intimate contact between them) and the full throttle position at which the further downward movement of the movable hollow valve body 18B is not permitted because the guide pins 16 engage with the lower ends 41 of the guide slots 39 of the guide wall 38.

The fuel sprayed through the fuel injection nozzle 5 is impinged against the top surface of the stationary valve body or disk 11C and forms a fuel film which expands from the center of the disk 11C radially outwardly toward the beveled edge 11*g*. The fuel film is separated at the beveled edge 11*g* and is atomized by the air flowing through the opening 40 into very fine particles. Thus the combustion mixture wherein the air and fuel particles are well and uniformly mixed, may be obtained. Since the metering surface 18' is inclined at an angle between 35° and 55° as described above, the air-fuel mixture flows along the inclined surface 18' toward the axis of the movable hollow valve body 12B so that more uniform mixing of the air and fuel may be ensured. Thus prepared uniform air-fuel mixture is charged into the cylinders of the engine 1 through the intake manifold 4.

The fuel sprayed over the stationary valve body or disk 11C is atomized along the whole beveled peripheral edge 11*g*, and the atomized fuel particles flow along the inclined metering surface 18' so that the fuel adhering to the inside wall surface 35*a* of the air-fuel passage of the lower half 32 may be minimized in quantity and consequently the formation of the fuel films thereover may be avoided or minimized.

Figure 18:
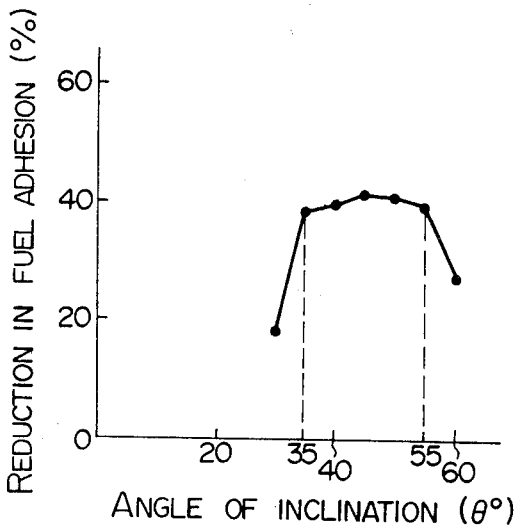
FIG. 18 is a view used for the explanation of the meritorious effects attained by the fifth embodiment.

The inventors conducted extensive tests in order to determine the optimum range of the angle of inclination $\theta$ (or the semivertical angle) at which the adhesion of the fuel to the wall 35*a* of the air-fuel passage of the lower half 32 and the resultant formation of the fuel film on it may be minimized. The results of the tests are graphyically shown in FIG. 18, the angle of inclination being plotted along the abscissa and the reduction ratio in %, along the ordinate. It can be seen that when the angle of inclination is between 35° and 55°, the reduction ratio higher than 40% can be attained. However, when the angle of inclination is decreased to, for instance, 30° or increased to, for instance, 60°, the reduction ratio becomes the order of 20% and the results of the tests varied over a wide range.

Figure 19:
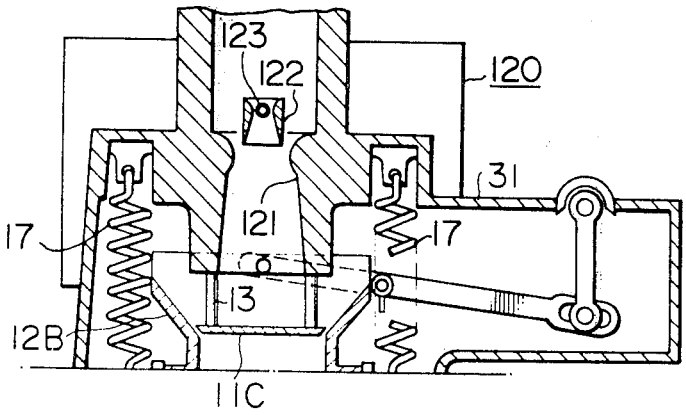
FIG. 19 is a longitudinal sectional view of a modification of a fuel supply means used in the fifth embodiment.

As in the second, third, and fourth embodiment, instead of the fuel injection valve 5, a conventional carburetor 120 featured in, for instance, a double venturi consisting of a primary venturi 122 with a discharge nozzle 123 and a secondary venturi 121 as shown in FIG. 19 may be used.

As described elsewhere, instead of a circular cross sectional configuration, the movable valve body 12 may have any suitable cross sectional configurations as needed. The stationary valve body or disk 11C and the air-fuel passage of the lower half 32 of the intake pipe 3 which mates with the movable valve body 12 must be changed in configuration correspondingly.

Sixth Embodiment, FIG. 20 through FIG. 23

Figure 20:
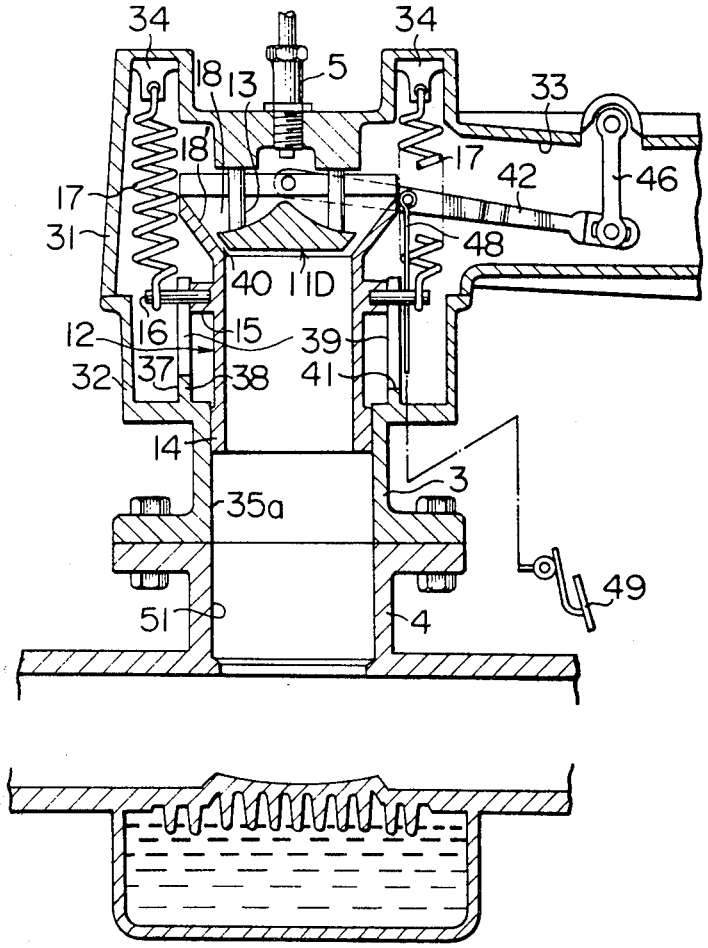
FIG. 20 is a longitudinal sectional view of a sixth embodiment of the present invention.
Figure 21:
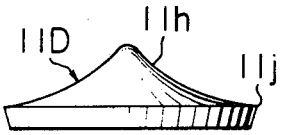
FIG. 21 is a front view, on enlarged scale, of a stationary valve body used in the sixth embodiment.
Figure 23:
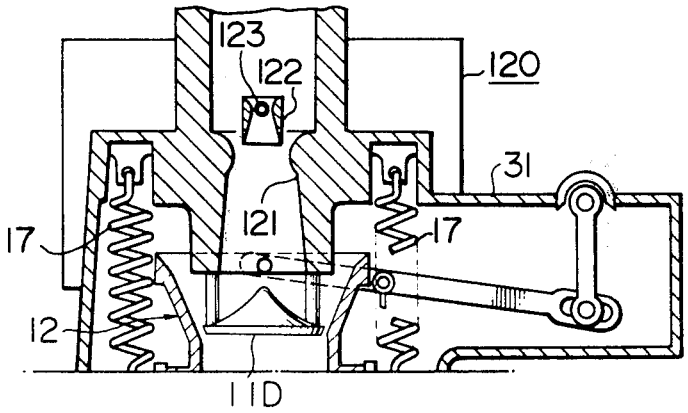
FIG. 23 is a longitudinal sectional view of a modified fuel supply means which may be used in the sixth mbodiment.

The sixth embodiment shown in FIGS. 20 and 21 is also substantially similar in construction to the first embodiment described hereinbefore, except that the stationary valve body 11D has in general a mountain-like or conical configuration having the height gradually reduced radially outwardly. As best shown in FIG. 21, the mountain-like valve body 11D has a concave upper surface 11*h* opposed to the fuel injection valve 5 to constitute a fuel receiving surface. The vertex of the mountain-like valve body 11D is on the axis of the valve body 11D, and the concave upper surface 11*h* gradually slopes down radially outwardly, and substantially symmetrically with respect to the axis of the valve body 11D. The base of the concave surface 11*h* is contiguous with the large base of a frustoconical guide surface 11*j*, which coacts with the inclined surface 18' of the metering passage 18 of the movable valve body 12 to define the opening 40 which varies its area as described elsewhere.

The fuel sprayed over the fuel receiving surface 11*h* of the stationary valve body 11D immediately flows radially outwardly without adhering to it toward the peripheral edge 11*j*. Since the fuel receiving surface 11*h* is smooth, the sprayed fuel may be prevented from rebounding at the surface 11*h* to the inclined surface 18' at the upper portion of the stationary valve body 12.

The fuel film is separated at the peripheral edge 11*j* and is atomized by the air flowing through the opening 40 at high velocities into extremely fine particles so that the combustion mixture, wherein the air and fuel are uniformly mixed, may be obtained.

Figure 22:
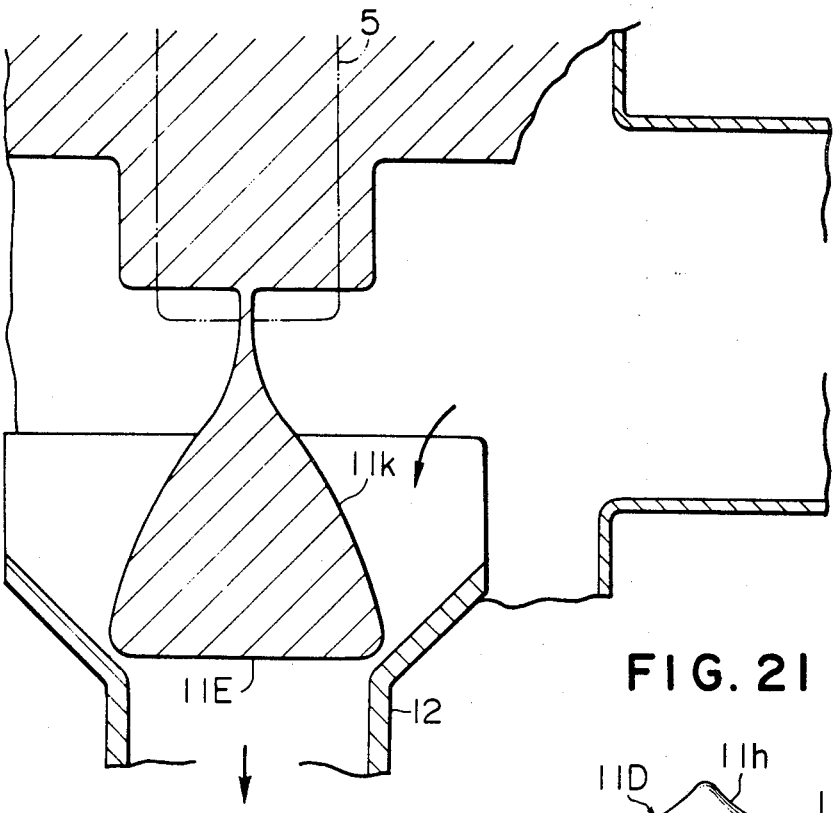
FIG. 22 is a fragmentary longitudinal sectional view, on enlarged scale, of a modification of the sixth embodiment including a modified stationary valve body.

Instead of the stationary valve body of the type described with reference to FIG. 21, a bell-shaped valve body 11E as shown in FIG. 22 may be used which has a convex fuel receiving surface 11*k*.

As with the second, third, fourth and fifth embodiments, instead of the fuel injection valve 5, a conventional carburetor featured in, for instance, a double venturi 120 consisting of a primary venturi 122 with a discharge nozzle 123 and a secondary venturi 121 may be used.

As described elsewhere, instead of a circular cross sectional configuration, the movable valve body 12 may have any suitable cross sectional configurations as needed. The stationary valve body 11D as well as the air-fuel passage in the intake pipe 3 which mates with the movable valve body 12 must be changed in configuration correspondingly.

Seventh Embodiment, FIGS. 24 through 28

Figure 24:
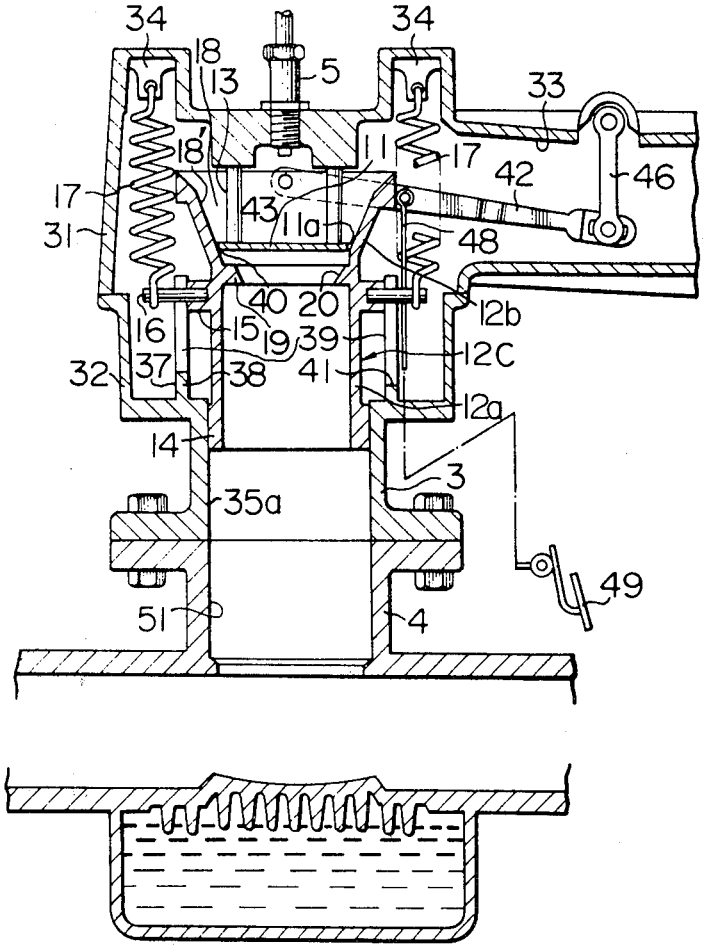
FIG. 24 is a longitudinal sectional view of a seventh embodiment of the present invention.
Figure 25:
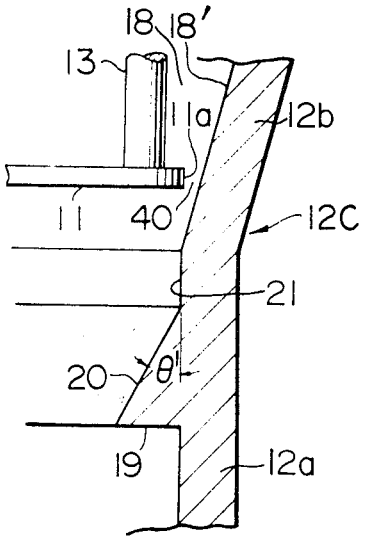
FIG. 25 is a fragmentary sectional view, on enlarged scale, thereof illustrating the relationship between a stationary valve body and a movable hollow valve body.
Figure 26:
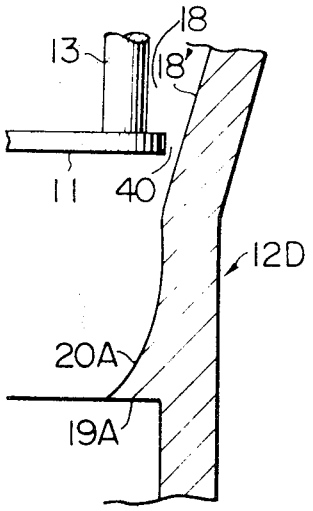
FIG. 26 is a fragmentary sectional view, on enlarged scale, of the seventh embodiment, illustrating a modified movable hollow valve body.
Figure 27:
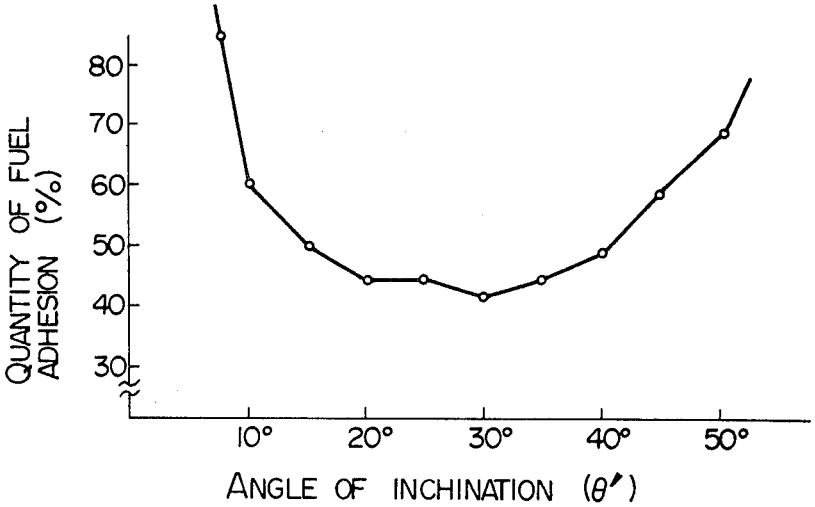
FIG. 27 shows a graph used for the explanation of the effects attained by the seventh embodiment.

The seventh embodiment shown in FIGS. 24 and 26 is also substantially similar in construction to the first embodiment described in detail with reference to FIG. 2 except that a flow guide 19 extends radially inwardly from the cylindrical portion 12*a* of the movable tubular body 12C adjacent to the boundary between the cylindrical and flared portions 12*a* and 12*b* so that a frustoconical flow guide surface 20 may be defined as best shown in FIG. 25. The angle of inclination $\theta'$ or the semivertical angle (See FIG. 25) of the guide surface 20 is preferably between 10° and 45°.

The mode of operation of the seventh embodiment is also substantially similar to those of the other embodiments described above. That is, the fuel sprayed over the top surface of the stationary valve body or disk 11 immediately flows from the center thereof radially outwardly toward the edge 11*a* at which the fuel film is separated from the stationary valve body or disk 11 and is atomized by te air flowing through the opening 40 at high velocities into very fine particles. As a result, the combustion mixture, wherein the air and fuel are uniformly mixed, may be obtained. Thus prepared air-fuel mixture flows along the inclined surface 18' of the metering passage 18 of the movable tubular or valve body 12C and then along the guide surface 20 of the guide 19 toward the axis of the movable tubular or valve body 12C so that the more uniform mixing of the air and fuel may be enhanced. The air-fuel mixture is charged through the intake manifold into the cylinders of the engine 1.

As described elsewhere, as compared with a butterfly valve, the change in opening area as a function of the stroke of the movalbe tubular or valve body 12C is very great. As a consequence, the angle of inclination or the semivertical angle of the surface 18' of the metering passage 18 of the movable tubular or valve body 12C must be made small. Then the fuel adhering to the wall surfaces will be inevitably increased in quantity. However, the seventh embodiment provides the flow guide 19 which has the flow guide surface 20 so that the fuel flowing down along the inclined surface 18' may be atomized again and the air-fuel mixture may be further redirected toward the axis of the movable tubular or valve body 12C. That is, the flow rate of the air-fuel mixture is controlled by the opening between the stationary valve body or disk 11 and the inclined surface 18' of the metering passage 18 of the movable tubular or valve body 12C, and the direction of the flow of the air-fuel mixture is controlled by the flow guide surface 20, whereby the atomization of the fuel and the uniform mixture of the air and fuel may be much facilitated. Thus when the flow guide 19 is provided, the uniform air-fuel mixture may be charged into the intake manifold 4 even when the angle of inclination or the semivertical angle of the inclined surface 18' of the metering passage 18 of the movable tubular or valve body 12C is reduced.

The inventors conducted the tests in order to find out the relationship between the angle of inclination or the semivertical angle $\theta'$ of the flow guide surface 20 and the reduction in quantity of the fuel adhering to the wall surface 35*a* of the air-fuel passage of the upper half 32 of the intake pipe 3 as compared with the case where no guide 19 is provided. The test conditions were that the rate of air intake was 20 g/sec; the intake negative pressure, −400 mHg; and the air-fuel ratio, 15. The test results are graphically illustrated in FIG. 27, the angle of inclination or the semivertical angle $\theta'$ being plotted against the abscissa while the quantity of fuel adhered to the wall surface 35*a* being plotted along the ordinate. The fuel quantity plotted along the ordinate is designated in % under assumption that the quantity of adhered fuel is 100 when the fow guide 19 is not provided. It can be seen that when the angle $\theta'$ is between 10° and 45°, the fuel adhering to the wall surface 35*a* can be considerably reduced in quantity. This means that the atomization and mixing performances are considerably improved.

Referring back to FIG. 25, the frustoconical, downwardly linearly converging guide surface 20 is connected to the inclined surface 18' of the metering passage 18 throug a stepped annular surface 21, but the guide surface 20 may be contiguous with the inclined surface 18'. For instance, as shown in FIG. 26, the guide 19A may extend radially inwardly in such a way that the curved guide surface 20A may be contiguous with the inclined surface 18' and consequently no sudden transition may be avoided between them.

Figure 28:
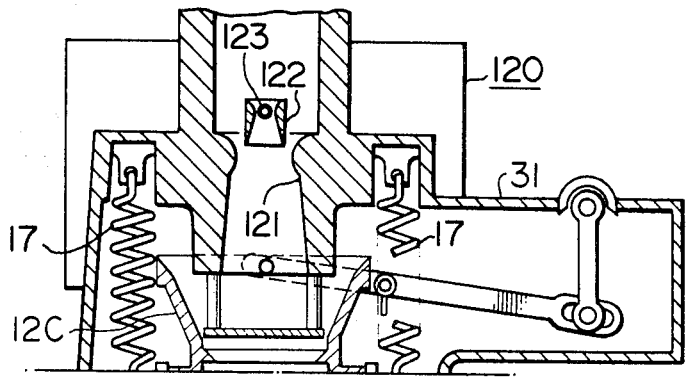
FIG. 28 is a longitudinal sectional view of a modification of a fuel supply means used in the seventh embodiment.

As described elsewhere, instead of the fuel injection valve 5, the conventional carburetor 120 featured in, for instance, a double venturi consisting of a parimary venturi 122 with a discharge nozzle 123 and a secondary venturi 121 as shown in FIG. 28 may be used.

As described elsewhere, in addition to a circular cross sectional configuration, the movable tubular or valve body 12C or 12D may have any suitable cross sectional configurations as needed. The stationary valve body 11 and the air-fuel passage of the lower half 32 of the intake pipe 3 must be correspondingly changed in configuration so as to mate with the movable tubular or hollow valve body 12C or 12D.

Figure 29:
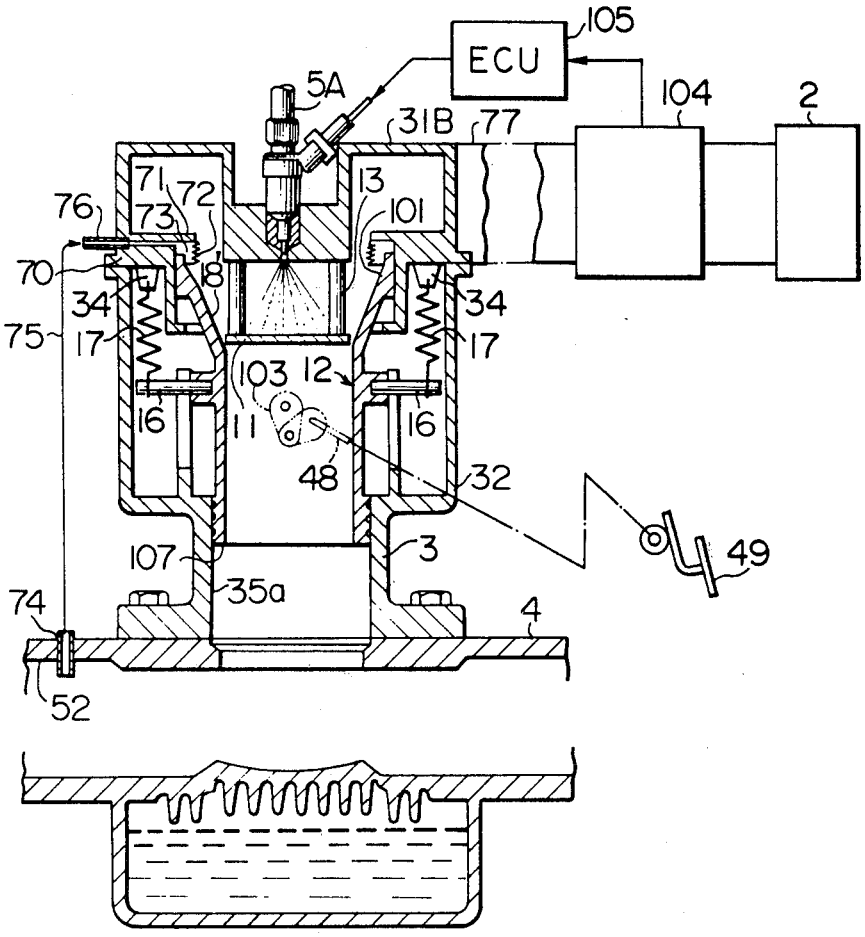
FIG. 29 is a longitudinal sectional view of an eighth embodiment of the present invention.

Eighth Embodiment, FIG. 29

The eighth embodiment shown in FIG. 29 is substantially similar in construction to the second embodiment described in detail with reference to FIGS. 3 through 6 except that the eighth embodiment is further provided with a negative pressure compensation system to be described in detail below.

The upper half 31B of the intake pipe 3 has a guide wall or horn guide 70 (which corresponds the guide wall 102 in the second embodiment) having an upper flange 71 extending radially inwardly. An annular bellows 72, which is a negative pressure compensation means, is mounted between the upper flange 71 and the upper end 101 of the movable tubular or valve body 12 so that an annular negative chamber 73 may be defined between the upper flange 71, the guide wall 70, the upper end 101 of the movable tubular or valve body 12 and the bellows 72. The negative pressure chamber 73 is communicated with the intake manifold 4 through a port 76, a negative pressure transmission line 75 and a port 74 opened into the common distribution passage 52 of the intake manifold 4.

Figure 3:
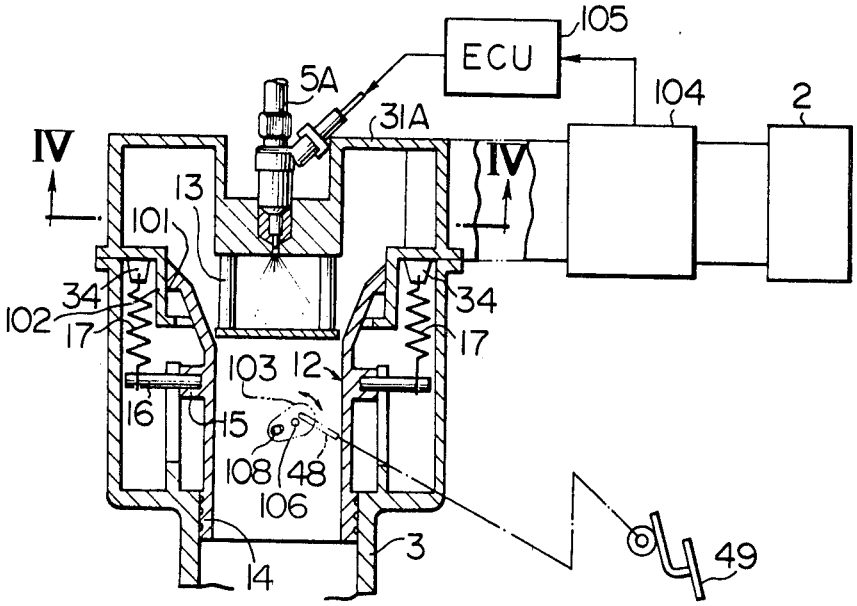
FIG. 3 is a longitudinal sectional view of a second embodiment of the present invention.

As described above, the eighth embodiment is substantially similar in construction to the second embodiment shown in FIG. 3. For instance, the air horn 77 is so arranged with respect to the upper half 31B that the air from the air cleaner 2 may flow into the upper half 31*b* tangentially (See FIG. 4).

The downward force (=the intake negative pressure X the area of the annular lower end 107) acts on the annular lower end 107 of the movable tubular or valve body 12, whereby the latter tends to be puled downward. However according to the eighth embodiment the negative pressure in the intake manifold 4 is transmitted into the negative pressure chamber 73 at the upper end 101 of the movable tubular or valve body 12 so that the upward force acts on the upper end 101, pulling the movable tubular or valve body 12 upwards. As a result, the downward force acting on the lower end 107 is cancelled by the upward force acting on the upper end 101. In this connection, it is to be noted that the area of the upper end 101 is designed substantially equal to that of the lower end 107.

With the negative pressure compensation system described above, the force applied to the accelerator pedal 49 becomes independent upon the intake negative pressure in the intake manifold 4 in all range of the engine operations and the bias springs 17 with a low spring constant may be used so that the distortions of the movable tubular or valve body 12 may be minimized and consequently the seizure between the movable tubular or valve body 12 and the wall surface 35*a* of the lower half 32 of the intake pipe 3 may be avoided.

In the eighth embodiment, any suitable fuel supply means may be used, but it is preferable to use the fuel injection valve 5A described in detail with reference to FIGS. 5 and 6. That is, the fuel injection valve 5A is of the swirling type so that the angle of spray is wide and consequently the fuel may be uniformly sprayed over the top surface of the stationary valve body or disk 11, whereby the localized concentrations of the fuel may be avoided.

It is preferable that the movable tubular or valve body 12 and the intake pipe 3 are made of dissimilar material such as aluminum and brass, but they may be made of a same material. In the latter case, either of the valve body 12 or the intake pipe 3 may be lined with a metal dissimilar to the metal of which the body 12 or pipe 13 is made so that the seizure or the like may be avoided and consequently the smooth movement of the movable tubular or valve body 12 may be ensured.

As described elsewhere, instead of a circular cross sectional configuration, the movable tubular or valve body may have any suitable cross sectional configurations as needed. In this case, the stationary valve body 11 and the fuel passage of the intake pipe 3 must be changed in configuration correspondingly so as to mate with the movable tubular or valve body 12.

In summary, according to the present invention, the atomization of the fuel may be much facilitated and the localized concentrations of the fuel in the entraining air may be avoided; that is, the uniform mixing of the air and fuel may be ensured so that the uniformity of air-fuel mixture distribution may be ensured, whereby the high engine performance may be ensured and the emission of pollutants may be minimized.

What is claimed:

1. In an intake system for an internal combustion engine of the type comprising an intake pipe, fuel supply means for charging a fuel into said intake pipe so as to form an air-fuel mixture, an intake manifold for distributing the air-fuel mixture into cylinders of said engine, and a throttling system incorporated in said intake pipe between said fuel supply means and said intake manifold for controlling the flow rate of the air-fuel mixture to be delivered to said intake manifold, the improvement wherein said throttling system comprises:

a stationary valve body having a surface spaced downstream from said fuel supply means by a predetermined constant distance in opposed relationship therewith and on which the charged fuel impinges, said stationary body being substantially in the form of a disc, a plurality of rods suspensing said stationary valve body from said intake pipe, and a movable tubular valve body having an outer wall surface, a part of whic is slidably closely engaged with an inner wall surface of said intake pipe downstream of said stationary valve body, and an inner wall surface which cooperates with at least a portion of the peripheral edge of said stationary valve body to define a valve opening in said intake pipe between said inner wall surface of said movable valve body and said portion of said peripheral edge, said inner wall surface of said movable tubular valve body being formed with recess means which cooperates with only a portion of the peripheral edge of said stationary valve body to define said valve opening until the opening area of said valve opening reaches a predetermined value, the valve opening being defined between the entire peripheral edge of said stationary valve body and the entire periphery of said inner wall surface of said movable tubular valve body when the opening area of said valve opening exceeds said predetermined value, said movable tubular valve body being movable relative to said stationary valve body in an axial direction of the former to vary the opening area of said valve opening, thereby controlling the air-fuel mixture charged into the cylinders of said engine.

2. An intake system as set forth in claim 1, wherein said recess is formed in plural portions of said inner wall surface of said movable hollow valve body symmetrically with respect to an axis of said movable hollow valve body.

3. An intake system as set forth in claim 1, wherein said inner wall surface of said movable hollow valve body is tapered or downwardly converged at an angle of 35 to 55 degrees.

4. An intake system as set forth in claim 1, further comprising a flow guide projecting radially inwardly from said movable tubular valve body adjacent to a downstream end of said inner wall surface of said movable tubular valve body, said flow guide having a guide surface tapered or converged downwardly toward an axis of said intake pipe.

5. An intake system as set forth in claim 4, wherein an angle of inclination or convergence of said guide surface is between 10 and 45 degrees.

6. An intake system as set forth in claim 4, wherein said guide surface is so curved as to be smoothly connected to said inner wall surface of said movable hollow valve body.

7. An intake system as set forth in claim 1, further comprising negative pressure compensation means provided at an upstream end of said movable tubular valve body for cancelling the force produced due to an intake negtive pressure acting on a downstream end of said movable tubular valve body.

8. An intake system as set forth in claim 1, 3, 4 or 5, wherein said fuel supply means includes a fuel injection valve.

9. An intake system as set forth in claim 1, or 7, wherein said fuel supply means includes a swirling type fuel injection valve adapted to spray fuel uniformly onto said stationary valve body.

10. An intake system as set forth in claim 1, 3 or 4, wherein said fuel supply means includes a carburetor.

11. An intake system as set forth in claim 1, 4 or 7, wherein said inner wall surface of said movable tubular valve body is tapered or downwardly converged toward a axis of said movable hollow valve body.

* * * * *